United States Patent [19]

Fincher et al.

[11] 4,293,086

[45] Oct. 6, 1981

[54] APPARATUS AND METHOD FOR SEPARATING CASE FLAPS

[76] Inventors: Paul A. Fincher, 1042 #3 Reed Ter., Sunnyvale, Calif. 94086; David R. Eklund, 3407 Victoria Ave., Santa Clara, Calif. 95051

[21] Appl. No.: 139,543

[22] Filed: Apr. 11, 1980

[51] Int. Cl.[3] ..... B26F 3/02

[52] U.S. Cl. ..... 225/1; 53/374; 53/381 R; 225/97; 225/103

[58] Field of Search ..... 53/374, 381 R; 225/1, 225/97, 103; 414/411, 412, 415, 416

[56] References Cited

U.S. PATENT DOCUMENTS

| | | | |
|---|---|---|---|
| 3,144,148 | 8/1964 | Merkner et al. | 414/416 X |
| 3,373,543 | 3/1968 | Nigrelli et al. | 53/381 R |
| 3,387,522 | 6/1968 | Standley | 53/381 R X |
| 3,533,214 | 10/1970 | Standley | 53/374 X |
| 3,559,368 | 2/1971 | Standley et al. | 53/374 X |

*Primary Examiner*—Frank T. Yost

*Attorney, Agent, or Firm*—Edward B. Gregg; Willis E. Higgins

[57] ABSTRACT

This apparatus separates downturned flaps of paperboard cases, which flaps are joined by tabs and lying over sides of the case, without requiring the use of a knife or other sharp instrument for cutting. The apparatus has a conveyor for moving the case through the apparatus. There is a first device for engaging one of the flaps. A first thrust device is positioned proximate to the conveyor and connected to the flap engaging device for moving it against the side of the case over which the one of the flaps lies, and below the flap. There is a device operatively coupled to the flap engaging device for moving it along the side of the case until at least a portion of the flap engaging device extends between the flap and the side against which it lies. A device for retracting the flap engaging device is connected thereto and does so with sufficient force to break the tab joining the flap to another one of the flaps of the case. The flap engaging device is preferably frustum shaped. In operation, the apparatus simulates the manual breaking of the tab.

16 Claims, 5 Drawing Figures

APPARATUS AND METHOD FOR SEPARATING CASE FLAPS

BACKGROUND OF THE INVENTION

1. Field of the Invention

This invention relates to an automated apparatus for separating downturned flaps of paperboard cases, which are joined by tabs to hold them against the sides of the cases while the cases pass through automated filling equipment. More particularly, it relates to an improved form of such apparatus, which gives an additional choice to using apparatus incorporating sharp instruments or simply relying on the manual breaking of the tabs. Most especially, it relates to such an improved apparatus, which is both safer and more reliable than prior art apparatus for cutting the flap tabs of such cases.

2. Description of the Prior Art

The use of and advantages of paperboard cases in which flaps for closing the cases after they have been filled are downturned and held together against the sides of the case by tabs connecting the flaps is both widely known and prevalent in the bottling and related industries.

A variety of automated apparatuses employing either fixed or movable knives, saws and similar sharp instruments for cutting the tabs so that the flaps can be folded over to seal the case after it has been filled are also known in the art. For example, such apparatuses are described in the following U.S. Pat. Nos.: Nigrelli et al, 3,373,543; Standley, 3,387,522; Standley et al, 3,559,368; Roth 3,593,489; Pagdin et al, 3,726,061 and Dichiara, 3,733,772.

Such apparatuses have achieved some acceptance in the bottling and related industries. However, it should be recognized that there is considerable dimensional variation in packing cases which are nominally of the same size. Since knives or other sharp instruments must be precisely positioned to cut the tabs without cutting or otherwise damaging the cases themselves, considerable precision in such apparatus is required. However, the result of feeding dimensionally imprecise cases through dimensionally precise slitting apparatus is often jamming of the cases in the apparatus.

While the necessity to correct jamming in such apparatuses is in itself a significant problem, the difficulties are compounded by the fact that bottling equipment operates on a high throughput basis. Workers on bottling and packing lines often attempt to correct such jamming quickly, to avoid the necessity of shutting down other portions of the line while the jam is corrected. The use of knives and other sharp instruments in such apparatuses therefore creates significant safety hazards for the workers when they attempt to correct jamming under such conditions. Thus, while the art pertaining to automatic slitting of tabs joining case flaps is a well developed one, a need still remains for the development of an apparatus and method for separating the flaps of such cases which will overcome the above and related problems.

SUMMARY OF THE INVENTION

Accordingly, it is an object of this invention to provide an automatic apparatus for separating flaps of cases joined by tabs which does not utilize knives or other sharp instruments for cutting the tabs.

It is another object of the invention to provide an automatic apparatus for separating flaps of cases joined by tabs, which apparatus is not susceptible to jamming due to dimensional variations in cases passed through the apparatus.

It is further object of the invention to provide an automatic apparatus for separating flaps of cases joined by tabs which is not a significant safety hazard for its operators.

It is still another object of the invention to provide an automatic apparatus which simulates manual breaking of tabs joining flaps of cases.

The attainment of the foregoing and related objects may be achieved through use of the novel apparatus and method herein disclosed. This apparatus and method separates downturned flaps of a paperboard or similar case joined by tabs which cause the flaps to lie over the sides of the case. The apparatus includes a conveyor for moving the case through the apparatus. A guide means positions the case as it moves into the apparatus. A flap engaging member, preferably generally frustum shaped, is connected to a thrust member adjacent the conveyor for moving the flap engaging member against a side of the case and retracting the flap engaging member therefrom to break. the tap. A further means moves the flap engaging member along the side of the case until at least a portion of the flap engaging member is between the downturned flap lying over the side of the case and the side, and adjacent the tap joining the downturned flap to a second downturned flap. In a preferred embodiment of the invention, the moving means is a second thrust means connected to pivot the first thrust means so that the flap engaging means will move along the side of the case.

The method of this invention for separating the downturned flaps of a case joined by a tab and lying over sides of the case includes the steps of: positioning a flap engaging means against a side of the case below one of the downturned flaps, moving the flap engaging means along the side of the case until at least a portion of the flap engaging means is between one of the downturned flaps and the side of the case, and then retracting the flap engaging means away from the side of the case to break the tab.

In the usual practice of the invention, adjacent flaps are joined by tabs at diagonally opposed corners of the case. First and second sets of the flap engaging means, the thrust means and the moving means are disposed opposite sides of the conveyor. If the two sets of flap engaging means, thrust means and moving means are separated along the path of travel of the conveyor by a distance approximately equal to the length of the case passed through the apparatus, they may be operated simultaneously to break each of the tabs at the same time. Alternatively, if the two sets of flap engaging means, thrust means and moving means are located directly opposite one another, the first set can be operated first in response to a leading edge of the case to break one of the tabs, and the second tab broken by the second set as the trailing edge of the case nears completion of its travel through the apparatus.

The attainment of the foregoing and related objects, advantages and features of the invention should be more readily apparent to those skilled in the art after review of the following more detailed description of the invention, taken together with the drawings, in which:

DETAILED DESCRIPTION OF THE INVENTION

Figure 1:
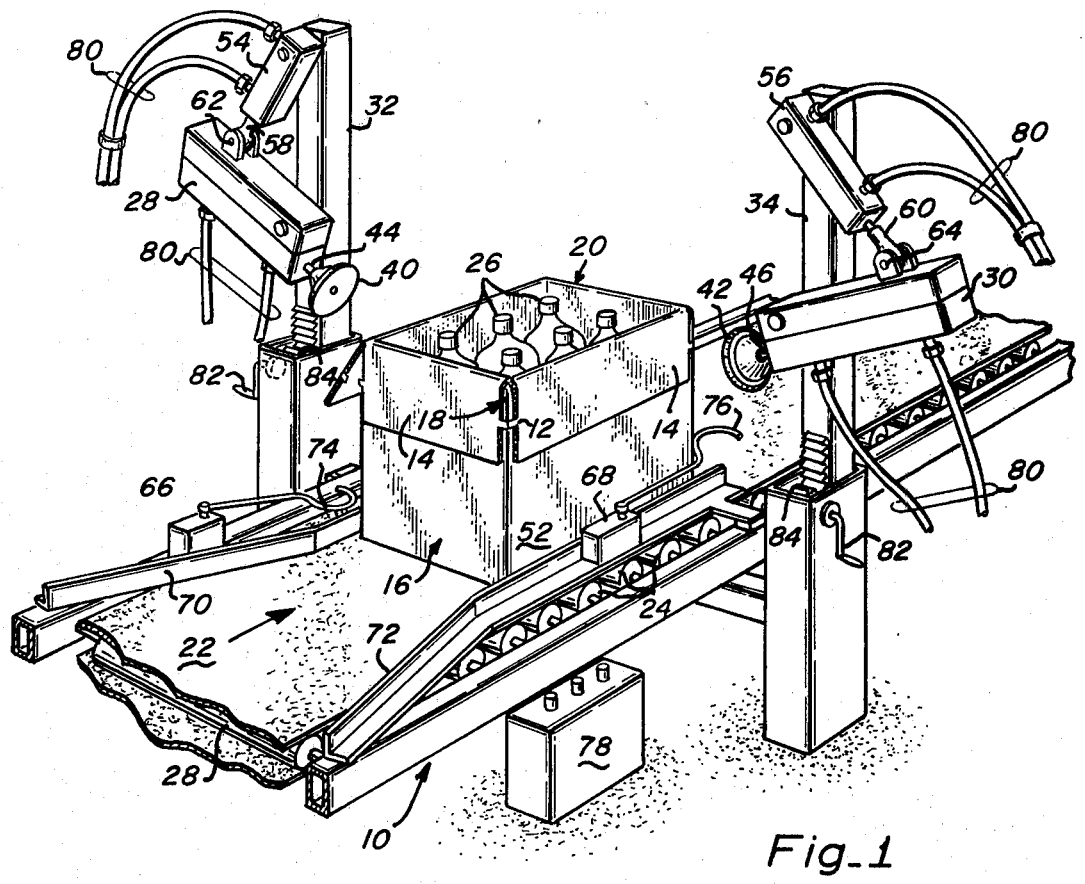
FIG. 1 is a perspective view of an apparatus in accordance with the invention in use.

Turning now to the drawings, more particularly to FIG. 1, there is shown a preferred form of an apparatus 10 for breaking tabs 12 joining flaps 14 of case 16, which connect the flaps 14 at diagonally opposed corners 18 and 20 of the case. An endless belt conveyor 22, supported by rollers 24 and driven in a conventional manner, moves the case 16 through the apparatus 10. As shown, the case 16 is already packed with bottles 26 containing, for example, a beverage. The apparatus 10 is located on the bottling line following the case packing equipment and before the case sealing equipment.

First and second pneumatic cylinders 28 and 30, each containing pistons (not shown) capable of being driven in two directions, are positioned opposite one another on each side of the conveyor 22. The cylinders 28 and 30 are pivotally mounted on first and second supports 32 and 34, respectively, by first and second bolts 36 and 38, best shown in FIGS. 2 and 3, near the front of each cylinder. As will be seen the supports 32 and 34 are in the form of racks which are moveable up and down within frame members by means of which height adjustment are made as described below. First and second flap engaging members 40 and 42 are mounted on piston rods 44 and 46, respectively.

Figure 4:
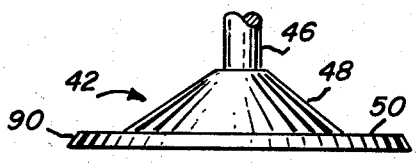
FIG. 4 is a side view of a preferred embodiment of a portion of the apparatus in FIGS. 1-3.

As best shown in FIG. 4 the flap engaging members 40 and 42 are generally frustum shaped. In particular, they are formed from two frustums 48 and 50, with the frustum 50 engaging side 52 of case 16 being substantially thinner than the frustum 48. A second set of pneumatic cylinders 54 and 56 and pistons (not shown) that may be driven in two directions are fixedly mounted on supports 32 and 34, respectively. Piston rods 58 and 60 extending from each cylinder 54 and 56 are connected to cylinders 28 and 30 by pivots 62 and 64, respectively. First and second micro switches 66 and 68 are positioned on guide rails 70 and 72 above the conveyor belt 22, respectively. First and second feelers 74 and 76 extend into the path of travel of a case 16 through the apparatus. Solenoid valves 78 are electrically connected to micro switches 66 and 68 in order to control the flow of compressed air to cylinders 28, 30, 54 and 56 by air lines 80 in a conventional manner. Cranks 82 operate rack and pinion mechanism 84 to allow height adjustment of supports 32 and 34 for positioning the cylinders 28, 30, 54 and 56 for different size cases to be passed through the apparatus. Bolts 85 (FIGS. 2 and 3) and apertures 87 allow support 89 to be telescoped for adjusting the width of the apparatus for different size cases, as well. Screw threaded members may also be substituted for the rack and pinion 84.

Figure 2:
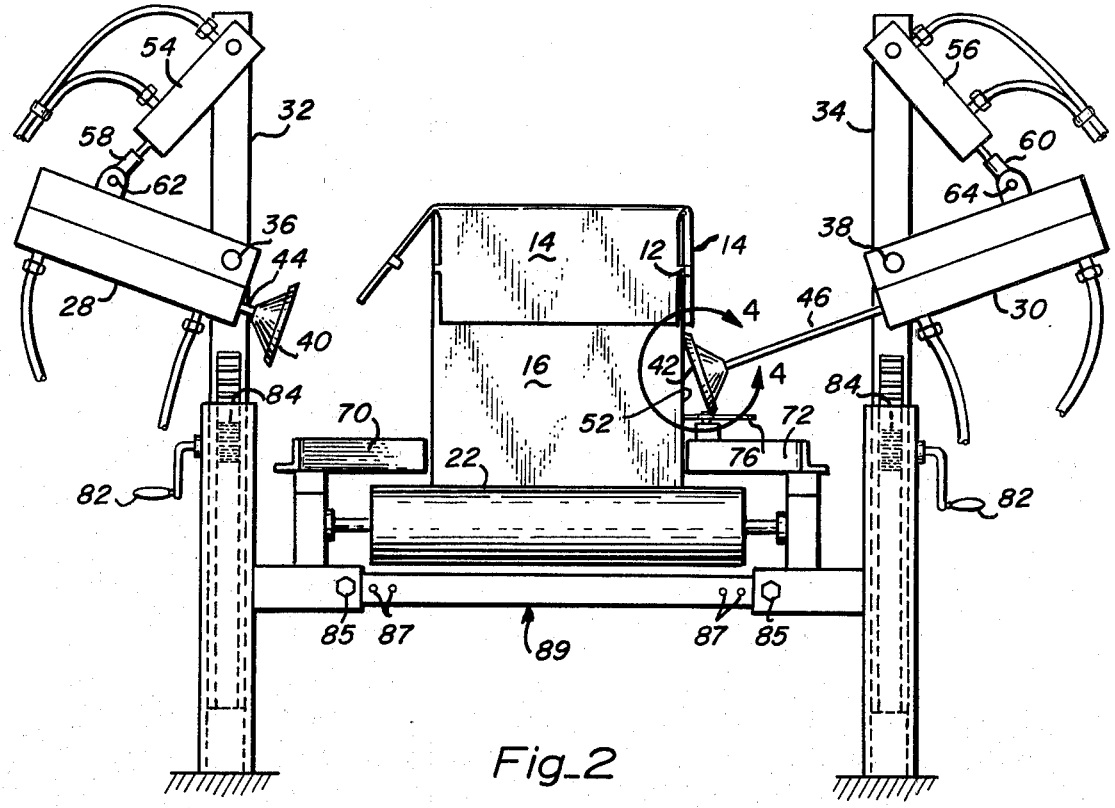
FIG. 2 is an end view of the apparatus shown in FIG. 1, but at a different stage of operation.
Figure 3:
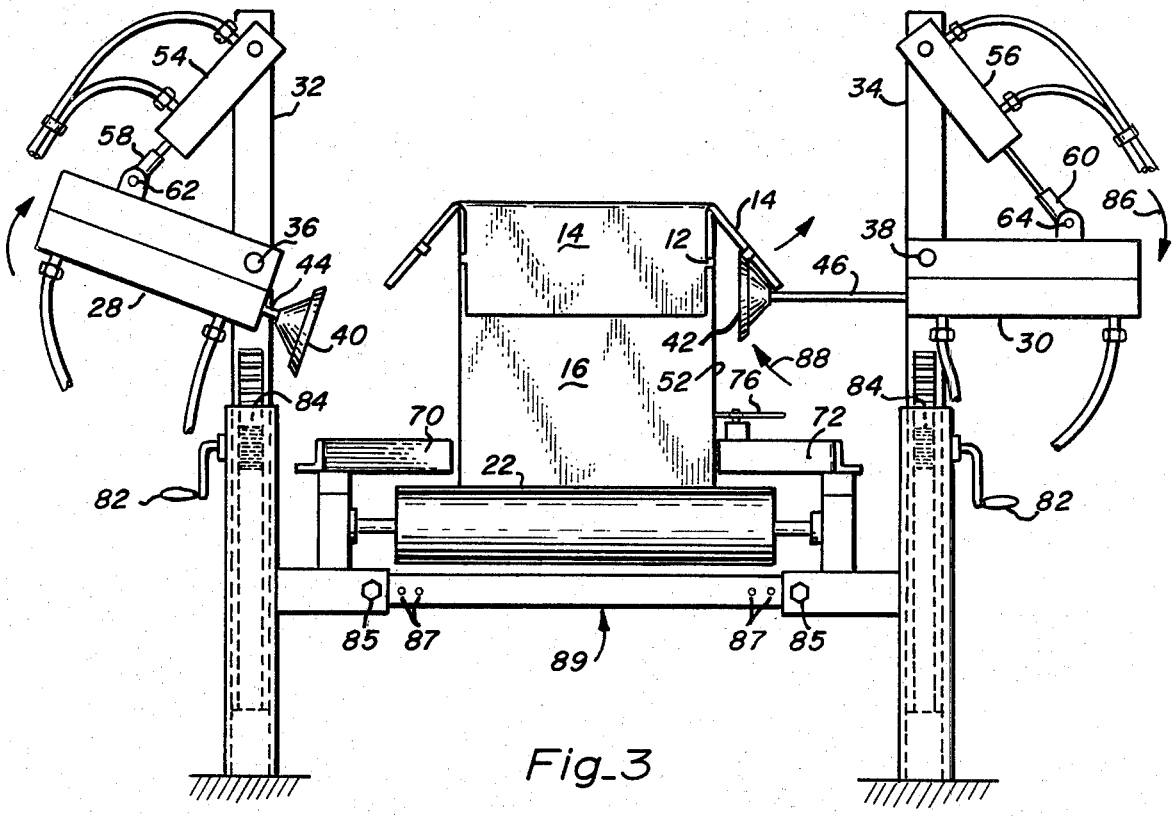
FIG. 3 is an end view similar to FIG. 2, but of the apparatus in a still different stage of operation.

The operation of the apparatus will now be explained, with the understanding that the case 16 in the position shown has already had tab 12 at the corner 20 broken by the flap engaging member 40, actuated by cylinder 28 and 54 in the same manner as will now be explained for flap engaging member 42, cylinder 30 and cylinder 56. It should be understood that the forward stroke of flap engaging member 40 was initiated by tripping micro switch 66 when case 16 engaged feeler 74. With the case 16 in the position shown in FIG. 1, feeler 76 is just being engaged by case 16 to trip micro switch 68, thus beginning a forward stroke by flap engaging member 42. In FIG. 2, the flap engaging member 42 has completed its forward stroke to engage side 52 of the case 16. With the flap engaging member 42 in this position, a downward stroke by the piston in cylinder 56 is initiated, thus pivoting cylinder 30 about pivot 38 as indicated by arrow 86 to the position shown in FIG. 3. This pivoting motion causes the flap engaging member 42 to move upwards along side 52 of the case 16, as indicated by arrow 88, continuing until the piston rod 46 is horizontal as shown in FIG. 3. Edge 90 of the flap engaging member 42, best shown in FIG. 4, facilitates the movement of the member 42 so that a portion of it is between side 52 of case 16 and the flap 14. A return stroke of the piston in cylinder 30, shown as partially completed in FIG. 3 then produces a sidewise pull on flap 14 to break tab 12. A return stroke of the piston in cylinder 56 then pivots cylinder 30 to return it to the position shown in FIG. 1.

Figure 5:
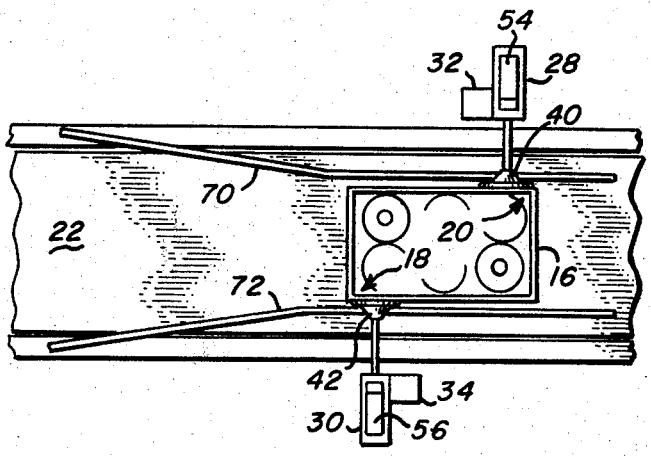
FIG. 5 is a top view of another embodiment of the invention.

If desired, support 32 can be positioned as shown in FIG. 5, further along the path of travel of belt 22, so that the pistons in cylinders 28 and 30 can be actuated simultaneously in response to engagement of a single feeler by case 16, so that flap engaging member 40 moves against the side of the case 16 near corner 20, while flap engaging member 42 moves against the side 52 of case 16 near corner 18 simultaneously. The remaining operations of the apparatus as described above are then also carried out simultaneously to break both tabs 12 at the same time. In either embodiment, the remaining operations are carried out in a suitable time sequence after the forward stroke is initiated, rather than requiring separate sensing means to initiate them.

It should now be apparent that a case tab breaking apparatus and method capable of achieving the stated objects of the invention has been provided. Because the apparatus and method of this invention simulates the manual breaking of the tabs rather than relying on a sharp instrument to cut the tabs, a significant safety hazard in prior art tab cutters has been eliminated. The apparatus is also less sensitive to dimensional variations in cases processed through the apparatus than prior art automatic apparatuses relying on sharp instruments for cutting the tabs.

It should further be apparent to those skilled in the art that various changes in form and detail of the invention as shown and described above may be made. It is intended that such changes be included within the spirit and scope of the claims appended hereto.

What is claimed is:

1. Apparatus for separating downturned flaps of a case joined by tabs and lying over sides of the case comprising:

a conveyor for moving the case through said apparatus, guide means for positioning the case as it moves into the apparatus, a generally frustum shaped member, first thrust means connected to said member and adjacent said conveyor for moving said member against a side of the case and retracting said member therefrom, and means for moving at least a portion of said member along the side of said case beneath the downturned flap lying over the side of said case and adjacent the tab joining the downturned flap to a second downturned flap.

2. The apparatus of claim 1 in which at least two frustum shaped members are provided, each connected to one of said thrust means and each of said thrust means being positioned so that said members move against opposite sides of the case adjacent diagonally opposed tabs joining their respective downturned flaps.

3. The apparatus of claim 1 in which said moving means is a second thrust means connected to pivot said first thrust means.

4. The apparatus of claim 1 or 3 in which said thrust means are fluid operated pistons and cylinders.

5. The apparatus of claim 1 in which said frustum shaped member comprises two frustums in stacked relationship, the one of which engages the side of the case being substantially thinner than the other frustum.

6. The apparatus of claim 1 additionally comprising control means for actuating said apparatus in response to presence of the case on said conveyor.

7. Apparatus for separating downturned flaps of a case joined by a tab and lying over sides of said case, which comprises:

a conveyor for moving the case through said apparatus, a first means for engaging one of the flaps, a first thrust means positioned proximate to said conveyor and connected to said flap engaging means for moving said flap engaging means against the side of the case over which the one of the flaps lies and below the one of the flaps, a first means for moving said flap engaging means along the side of the case until at least a portion of said flap engaging means extends between the one of the flaps and the side against which it lies, and a first means for retracting said flap engaging means with sufficient force to break the tab.

8. The apparatus of claim 7 additionally comprising a second flap engaging means, thrust means, moving means, and retracting means positioned on the other side of said conveyor from the first flap engaging means, thrust means, moving means and retracting means, and in which the case has tabs on diagonally opposing corners joining their respective flaps.

9. The apparatus of claim 8 in which said first and second flap engaging means, thrust means, moving means and retracting means are respectively positioned directly opposite each other on their respective sides of said conveyor and operation of said first thrust means is initiated to engage the side of the case shortly after a leading end of the case passes in front of it, and operation of said second thrust means is initiated later and shortly before a trailing edge of the case passes in front of it.

10. The apparatus of claim 8 in which said second flap engaging means, thrust means, moving means and retracting means is positioned further along the path of travel of said conveyor a distance approximately equal to the length of the case, said first and second flap engaging means moving substantially simultaneously against their respective sides of the case near their respective diagonally opposing corners having the tabs joining their respective flaps.

11. The apparatus of claim 7, 8, 9 or 10 in which said thrust means, moving means and retracting means are fluid operated pistons and cylinders.

12. The apparatus of claim 7, 8, 9, 10 or 11 in which said moving means pivots at least a portion of said thrust means and said retracting means to move said flap engaging means along the side of the case.

13. The apparatus of claim 7, 8, 9, 10 or 11 in which said flap engaging means is substantially frustum shaped.

14. A method for separating downturned flaps of a case joined by a tab and lying over sides of the case, which comprises:

positioning a flap engaging means against a side of the case below one of the downturned flaps, moving said flap engaging means along the side of the case until at least a portion of said flap engaging means is between the one of the downturned flaps and the side of the case, and retracting the flap engaging means away from the side of the case to break the tab.

15. The method of claim 14 in which tabs join their respective flaps at diagonally opposing corners of the case, and first and second flap engaging means are positioned against opposing sides of the case near the corners joining their respective flaps, moved along and retracted from their respective sides.

16. Apparatus for separating flaps of a case having a polygonal shape and at least one pair of downturned flaps lying along two adjacent side walls of the case with one edge of each such flap attached to the other flap of the pair by a tab, comprising:

a conveyor for carrying cases in succession to and past a flap separating station, flap opening means located at such station which is capable of contacting one of said adjacent side walls, then penetrating between the respective flap and side wall and then exerting an outward pull on the flap to tear the tab, and means for automatically so operating said flap opening means.

* * * * *